US005431035A

United States Patent [19]

Sheen

[11] Patent Number: 5,431,035

[45] Date of Patent: Jul. 11, 1995

[54] HYDRAULIC PIPE BENDER OF LARGE DIMENSION

[76] Inventor: Reen Y. Sheen, 170, Section 2, Cgung-Son Rd., Chung-Ho City, Taipei, Taiwan

[21] Appl. No.: 28,954

[22] Filed: Mar. 10, 1993

[51] Int. Cl.[6] ..... B21D 7/08

[52] U.S. Cl. ..... 72/133; 72/171; 72/173

[58] Field of Search ..... 72/133, 170, 171, 173, 72/174, 175, 370, 369

[56] References Cited

U.S. PATENT DOCUMENTS

| | | | |
|---|---|---|---|
| 928,073 | 7/1909 | Schneider | 72/175 |
| 2,335,028 | 11/1943 | Rose et al. | 72/171 |
| 2,467,671 | 4/1949 | Hulburt et al. | 72/175 |
| 3,742,748 | 7/1973 | Ehm | 72/369 |
| 4,331,016 | 5/1982 | Benteler et al. | 72/133 |

FOREIGN PATENT DOCUMENTS

| | | | |
|---|---|---|---|
| 2058238 | 6/1992 | Canada | 72/133 |
| 3248719 | 11/1991 | Japan | 72/133 |
| 4127919 | 4/1992 | Japan | 72/173 |
| 2188265 | 9/1987 | United Kingdom | 72/170 |

*Primary Examiner*—Lowell A. Larson
*Attorney, Agent, or Firm*—Bucknam and Archer

[57] ABSTRACT

This invention provides a hydraulic pipe bender of large dimension, comprising a frame, roller group, gear group, hydraulic mechanism, clutch, lifting mechanism, guiding mechanism, feeding mechanism, and bending mechanism. A guiding mould of the guiding mechanism is attached on the mould of the left roller, and the pipe to be processed is sheathed on the guiding rod, and is fed rightward through the feeding mechanism to prevent the slipping phenomena during the bending process; besides, by means of the hydraulic mechanism and the gear group, the rollers group can adjust the speeds of the top, left or right roller automatically to manufacture a circular ring pipe of large dimension.

4 Claims, 13 Drawing Sheets

HYDRAULIC PIPE BENDER OF LARGE DIMENSION

BACKGROUND OF THE INVENTION

This invention relates to a hydraulic pipe bender of large dimension, particularly a device through which a pipe is guided, fed by a guiding mechanism, a feeding mechanism, wherein slipping or staggering phenomena will be prevented during the bending process. Besides, the speeds of the top, right or left roller can be adjusted automatically according to the load variation during the operation to bend a smooth metal pipe ring.

When a standard sheet metal plate is rolled into a cylindrical shape, the most popular method is to use three rollers with identical diameters, as shown in FIG. 1 which shows the working principle of bending a plate on conventional rollers. The positions of the two lower rollers are fixed first, then the height of the top roller can be adjusted. Therefore, cylinders of various diameters can be produced therefrom. The closer the distances are among the three rollers, the smaller the diameter of a metal cylinder will be produced, i.e. a circle is obtained by the three points where the metal plate contacts the three rollers.

In a metal cylinder, due to the thickness of the metal plate itself, there is a difference between the inner ring (I.D.) and outer ring (O.D.), however it will not effect the speed of the rollers seriously. When a rolling machine is used to bend a metal pipe into a circular ring, due to the diameter of the metal pipe itself, the inner (I.D.) and outer (O.D.) ring circumferences will result in a great difference. However, the speeds of the three rollers are completely identical, so they will not be effected by the difference between inner and outer circumference. Thus to comply with the load variation of the inner circumference and load variation of the metal pipe, intermedient staggering will occur in the top roller. It will not produce a smooth circular metal pipe ring, besides the universal joint of the top roller breaks frequently.

Accordingly, usually an electric motor is used in the manufacturing field to rotate the top roller, and the two bottom rollers are moved by another motor, so that the top roller, to comply with the inner circumference and load variation, will reduce the speed automatically. However, the effect of the technical means may not be perfect. Further, such troubles as damage to the motor, difficult starting and slow braking may occur. They create problems to the manufacturer.

Furthermore, by adjusting the height of the center of the top roller, the diameter of a circular metal pipe ring can be determined. However, during the bending process, the front and the rear portion of the metal pipe ring will curve upwards, which causes difficulty to manufacture a totally smooth circular metal pipe ring of large dimension. Besides, during the bending process of a metal pipe, no suitable feeding mechanism and guiding .mechanism cooperate. Usually it will stag or stop easily, and it becomes difficult to manufacture a smooth circular metal pipe ring with a large dimension. Besides, during the process of bending a metal pipe, neither the feeding mechanism nor guiding mechanism is synchronized, therefore, the staggering and slipping phenomena will occur easily, causing difficulty to manufacture a smooth circular metal pipe ring with a large dimension.

Due to this shortcoming of operation in bending a pipe as mentioned above, the inventor has tried to overcome this manufacturing problem. Through numerous trials, analysis and tests, finally this invention "A hydraulic pipe bender of large dimension" is achieved.

SUMMARY OF THE INVENTION

The object of this case is to provide a hydraulic pipe bender of large dimension, so that the lifting position of the right roller can be adjusted and controlled by cooperating with the top roller and the left roller. Then the dimension of the pipe ring will be decided and achieved. Besides, the pipe to be manufactured is operated by a guiding mechanism and a feeding mechanism to prevent the staggering and slipping phenomena of a metal pipe during the bending process. Further, by providing a central roller under the top roller, the bending of a slim pipe can be accommodated with the load variation during operation by adjusting the speed of the top roller or left and right rollers to manufacture a circular metal pipe ring of large dimension.

To achieve the above objective, an embodiment is described to illustrate the technical means and efficacy with the help of the following drawings.

LIST OF PARTS

Figure 1:
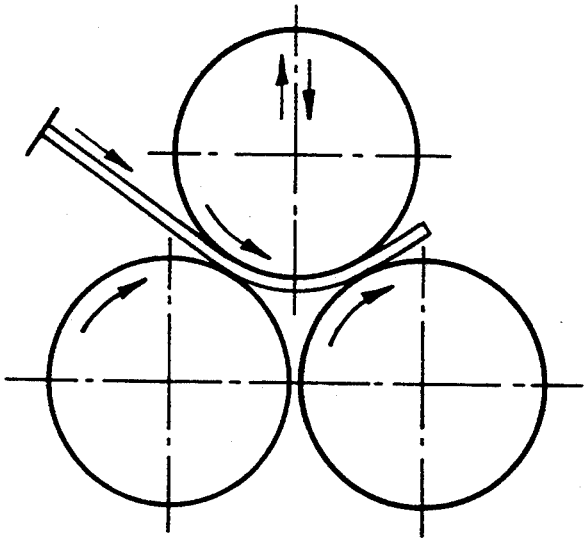
FIG. 1 (PRIOR ART)
FIG. 1 is a diagram showing the working principle of a conventional bending machine.

1 frame
- 11 gear box
- 12 head seat
- 13 tail seat
- 14 guiding slot

2 roller group
- 21 top roller
- 22 left roller
- 23 right roller
- 24 slidable seat
- 25 central roller
- 26 universal joint
- 27 chain wheel 28 chain wheel
29 mould
3 gear box
31 top shaft
32 left shaft
33 right shaft
34 chain wheel
35 gear
36 top hydraulic motor
37 gear
38 left hydraulic motor
39 gear
4 lifting mechanism
41 thread lifter
42 thread
43 connecting rod shaft
44 hydraulic motor
45 chain
46 numerical counter
5 bending mechanism
51 inner mould
52 jaw
53 removable jaw
54 jaw seat
55 fixing screw
56 outer mould
57 rack
58 gear
6 hydraulic mechanism
61 oil tank
62 hydraulic pump
63 control valve
7 clutch mechanism
71 fixed shaft
72 clutch gear
73 handle
8 guiding mechanism
81 base
82 rack
83 hydraulic cylinder
84 joint
85 guiding rod
86 guiding mould
87 metal pipe
9 feeding mechanism
91 feeding seat
92 shaft
93 gear
94 helical gear
95 hydraulic pump
96 roller
10 electrical power panel

DETAILED DESCRIPTION OF A PREFERRED EMBODIMENT

Figure 2:
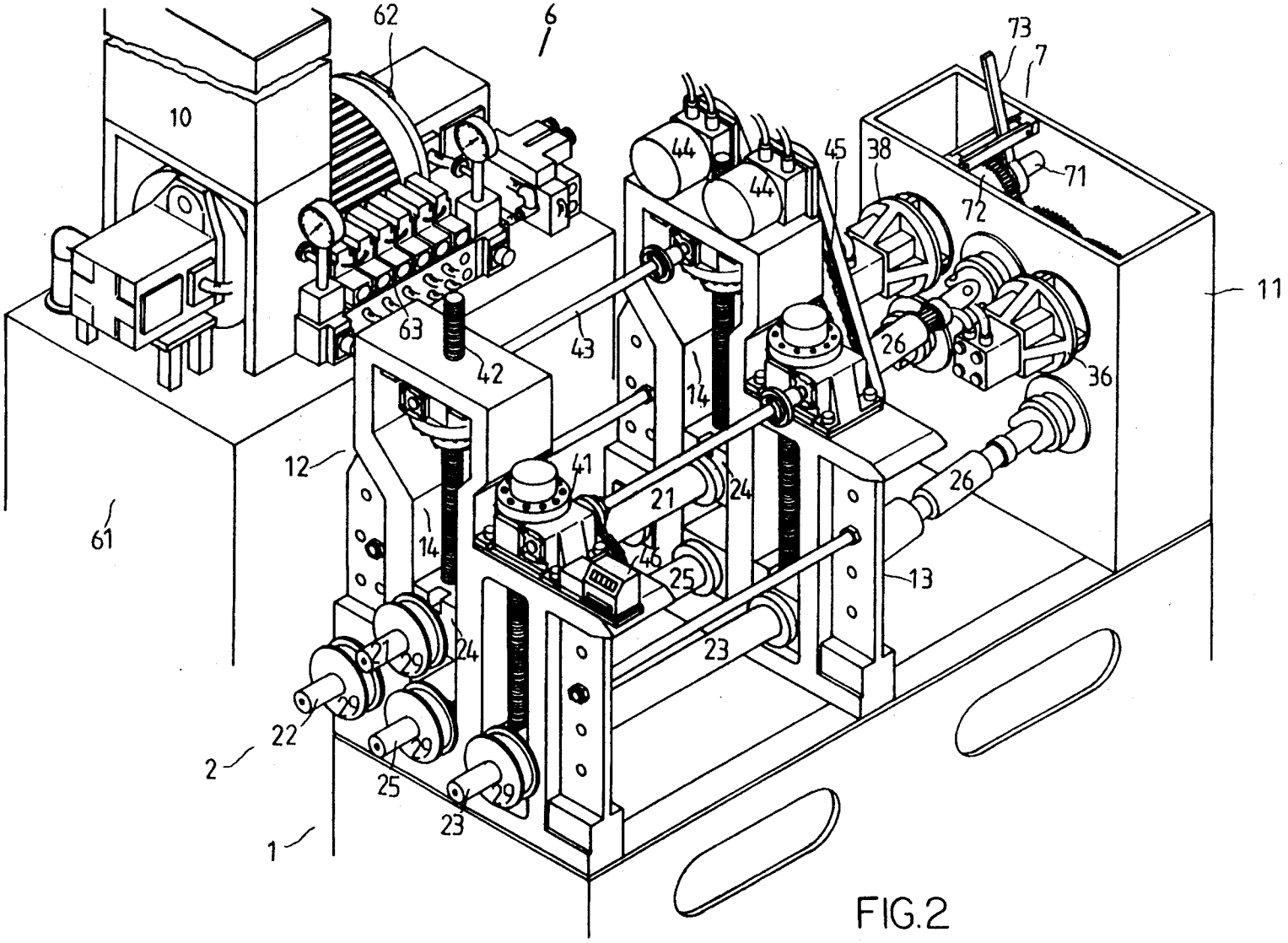
FIG. 2 is a perspective view of a pipe bender of this invention.
Figure 3:
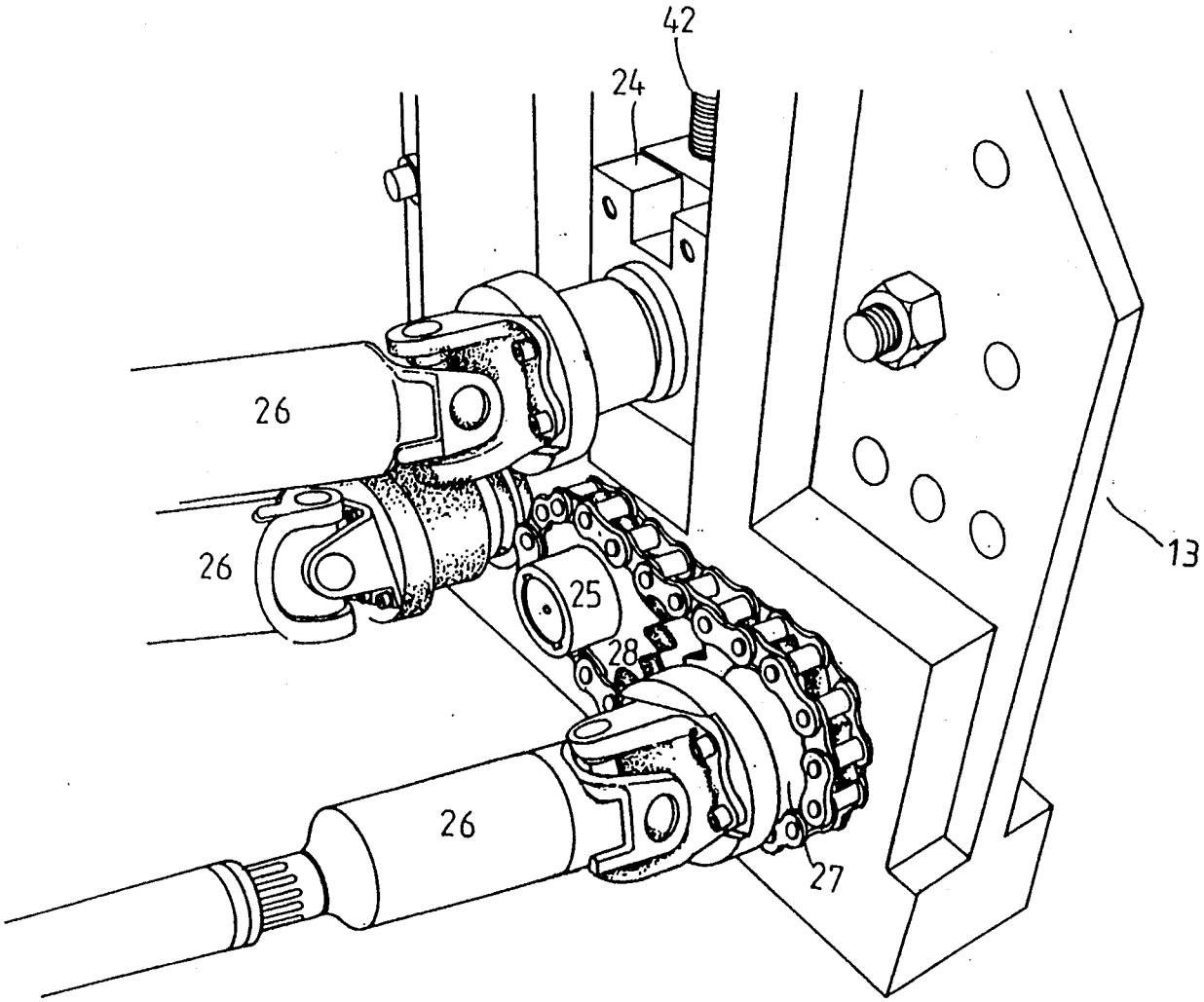
FIG. 3 is a perspective view showing the rear portion of the pipe bender of this invention.

Now referring to FIG. 2 which is a perspective view of the pipe bender and FIG. 3 which is a perspective view of the latter part of the pipe bender of this invention. This hydraulic pipe bender of large dimension of the embodiment is comprised of frame 1, roller group 2, gear group 3, lifting mechanism 4, bending mechanism 5, hydraulic mechanism 6, clutch mechanism 7, guiding mechanism 8 (shown in FIG. 4), feeding mechanism 9 (shown in FIG. 4), electric power panel 10. Top, left, right rollers 21, 22, 23 are rotated by means of gear group 3 and hydraulic mechanism 6, besides, it can vary according to the operation of the rollers, so that the rotation of top roller 21 or left or right roller 22, 23 can be adjusted to produce a smooth circular metal pipe ring with good quality.

Frame 1 is a rectangular frame made by folding and welding steel plates and is supported on the ground by several pillars. A tail seat 13 is welded across the central portion between the two sides of the rectangular frame, and a head seat 12 is provided at the opposite side. The roller group 2 is comprised of top, left, right and central rollers 21, 22, 23 and 25. The end of each roller penetrates through the sliding seat 24 of tail seat 13 and pivotedly mounted at the internal bearing of sliding seat 24. The head of each roller penetrates through the sliding seat 24 of the head seat 12, wherein top roller 21 and right roller 23 and slide seat 24 can be lifted or lowered in guiding slot 14.

Figure 10:
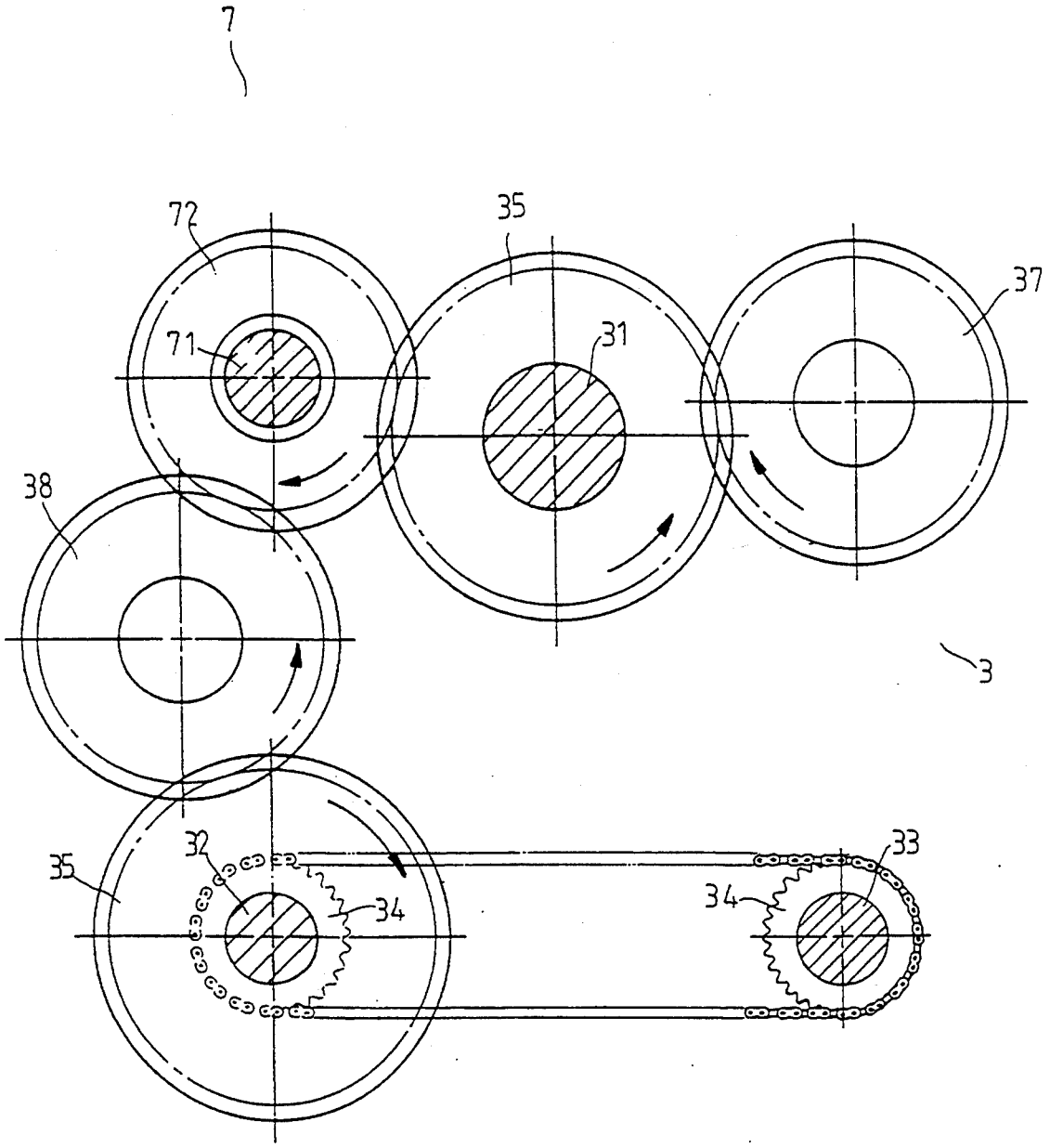
FIG. 10 is a diagram showing the meshing action of the clutch mechanism of this invention.

Each end of the top, left and right rollers 21, 22 23 connects with universal joints 26, and the rear end of each universal joint 26 is connected with the top shaft 31, left shaft 32, right shaft 33 of the gear group 3 (shown in FIG. 10). Top hydraulic motor 36 and left hydraulic motor 38 are used to drive top roller 21, left roller 22 and right roller 23. The central roller 25 of the roller group is located between left roller 22 and right roller 23 and exactly below the top roller 21.

Please refer to FIG. 3 which shows the rear portion of left roller 22, central roller 25 are connected with chain wheel 27, 28 which are connected by a chain, so that left roller 22 and central roller 25 rotate synchronically along the same direction. The lifting mechanism 4 is provided with two sets of thread lifters 41 at the head seat 12 and tail seat 13, so that thread 42 connects downwardly with the sliding seat 24 of top roller 21, right roller 23. The two sets of thread lifters 41 at the tail seat 13 are provided with a pair of hydraulic motors 44 respectively, so that the main shaft of thread lifter 41 can be moved relatively by a chain 45, and thread 42 of the thread lifter can be moved correspondingly. Between head seat 12, tail seat 13 and thread lifter 41, connecting shaft 43 is directly connected so as to move synchronically and produce a steady lifting and lowering of top roller 21, right roller 23 and adjust the height position of the center roller 25. Netherless to say, the lifting mechanism 4 of the embodiment can be provided with a mechanical numerical counter 46 to show the number of lifting and lowering for reference, or a scale with height measurement may be alternatively provided at the head seat 12.

Figure 4:
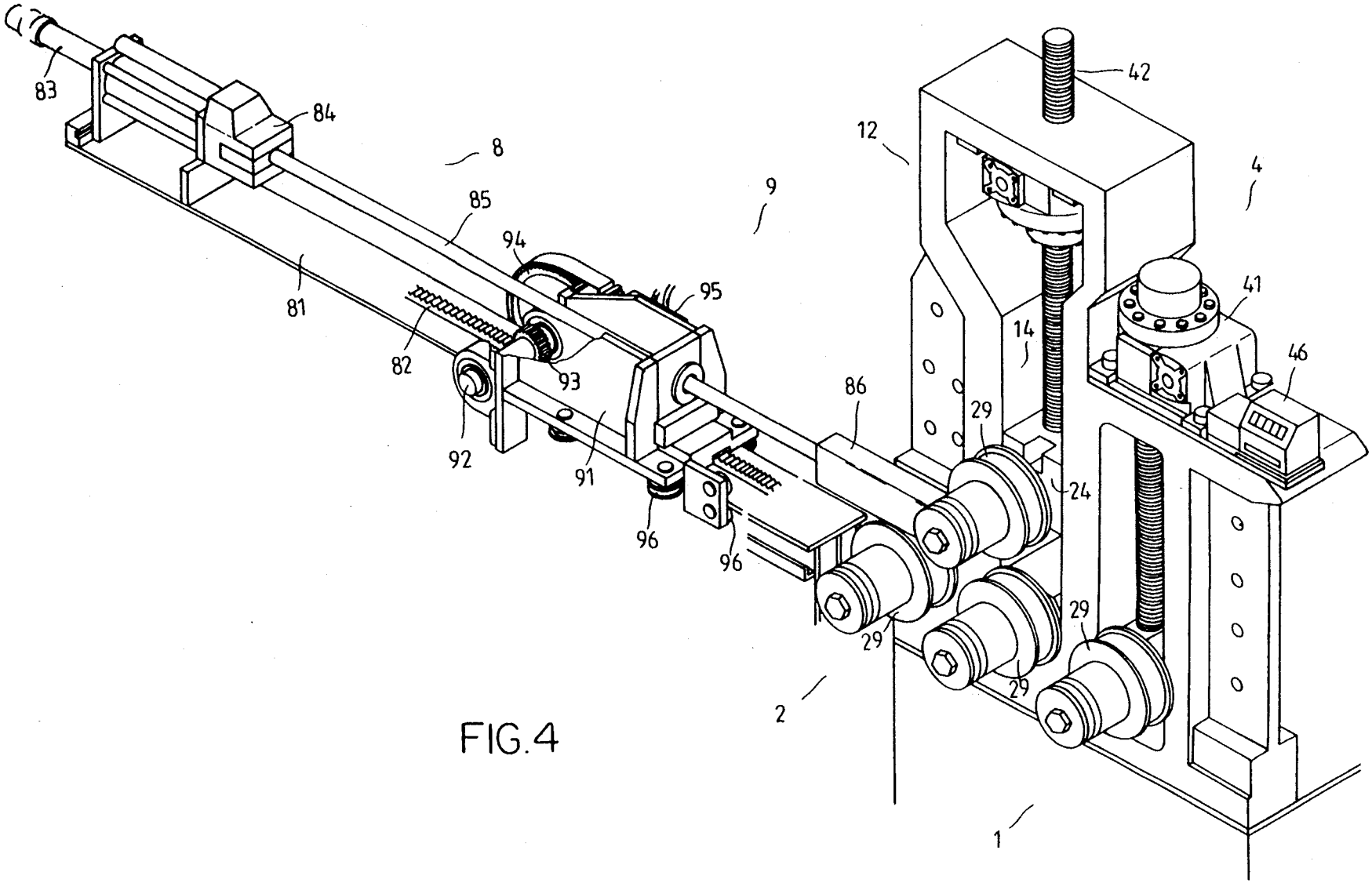
FIG. 4 is a perspective view showing the front portion of the pipe bender of this invention.
Figure 5:
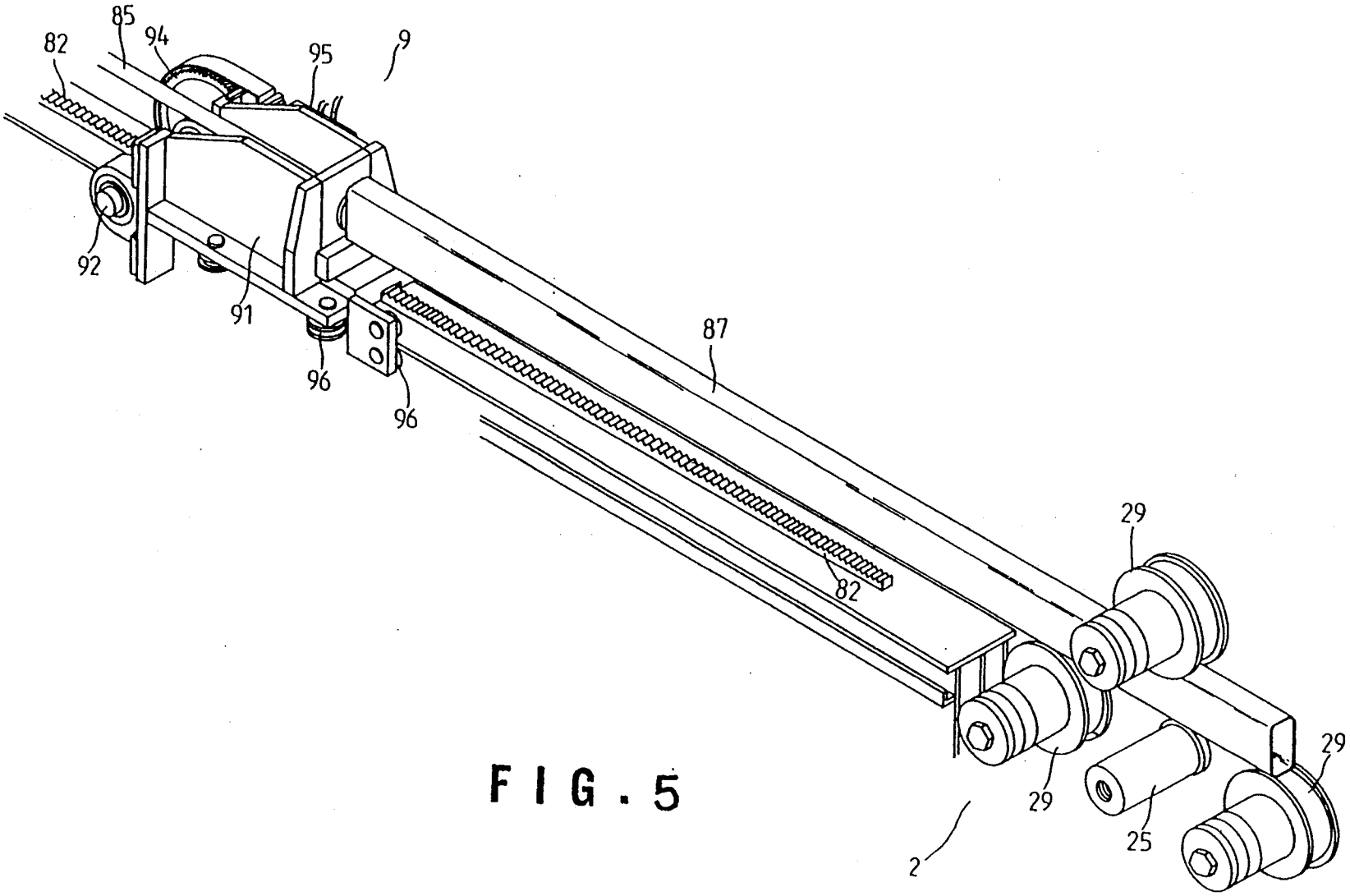
FIG. 5 is a perspective view showing the operational status of this invention.

Now refer to FIG. 4 which is a perspective view of the front portion of the pipe bender and FIG. 5 which is a perspective view showing the operational status of this invention. In the guiding mechanism 8, a hydraulic cylinder 83 is provided above base 81, so that the front end of the piston rod 83 face rightward, and a connecting head 84 and a guiding rod 85 are connected at the front end of the piston rod, so that connecting rod 85 penetrates through the feeding seat 91 of the feeding mechanism 9 and extends continuously horizontally, and, a guiding mould 86 is fixed at the right end, so that guiding mould 86 is located above mould 29 of roller 22 of the roller group 2. The cross-section of guiding mould 86 is made according to the hollow shape of metal pipe 87 to produce a smooth feeding. The feeding seat 91 of the feeding mechanism 9 is located above base 81, rollers 96 are pivoted at the front and rear sides of the bottom of feeding seat 91, and the front and rear edges of base 81 are the rails. Besides, two sets of rollers 96 are pivoted and roll along the bottom of base 11; they are incorporated as the rail for the leftward and rightward moving of feeding seat 91. A hydraulic motor 95 facing rightward is mounted at the rear end of feeding seat 91, so that helical gear of the rotating shaft will mesh with the helical gear 94 of the rotating shaft 92 of the feeding seat 91, so that rack 82, mounted above the base 81 is meshed, and the whole rack 82 extends left and rightward along the base 81. By means of hydraulic motor 95 and the rotation of helical gear 94 and gear 93, with the guidance of the fixed rack 82, the feeding seat 91 can be moved rightward or leftward. The guiding rod 85 of the guiding mechanism 8 extends leftward or rightward, and guiding mould 86 at the right end of guiding rod 85 is near above the mould 29 of the left roller 22. Besides, the right section of the guiding mould 86 extends beyond left roller 22. When this embodiment is in operation, the metal pipe 87 (rectangular pipe) is sheathed on the guiding rod 85 and guiding mould 86, so that the left end of the metal pipe 87 is pushed against the right wall of feeding seat 91, and the right end is above the right roller 23. Of course, hydraulic motor 95 will be driven by feeding mechanism 9, and feeding seat 91 can be controlled at a proper pre-determined position by means of rotating gear 93 in accordance with rack 82.

Figure 6:
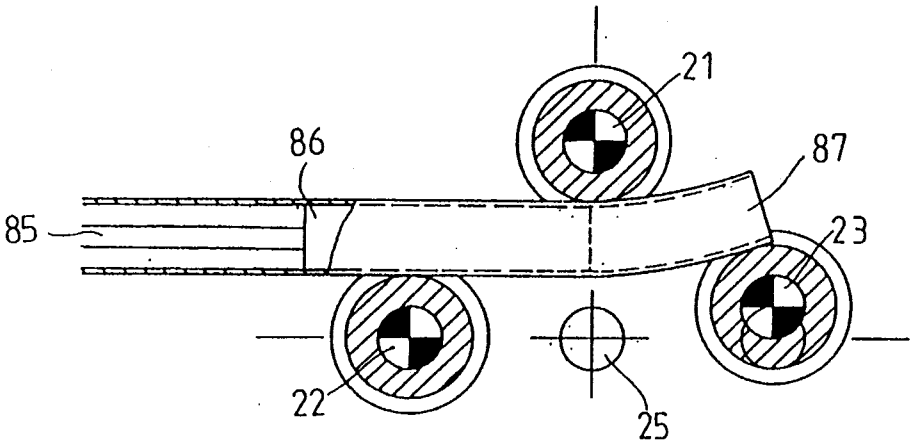
FIG. 6 is a view showing the lifting status of the right roller of this invention.

Now refer to FIG. 6 which shows the right roller of the pipe bender of this invention in a lifted position. The lifting mechanism 4 of the embodiment drives right roller 23 upwards by means of hydraulic motor 44 and thread lifter 41 and thread 42 to a pre-determined height. With the cooperation of guiding mechanism 8 and feeding mechanism 9, the right end of metal pipe 87 is bent upward, however the left portion at left of the central line of the top roller 21 is still kept straight. The height of the right roller 23 of the embodiment decides the diameter of the circular metal pipe ring. The higher the position of the center of right roller 23, the smaller the diameter of the circular ring of metal pipe 87; and the lower the center of the right roller 23, then the diameter of the circular metal pipe ring will become larger.

Figure 7:
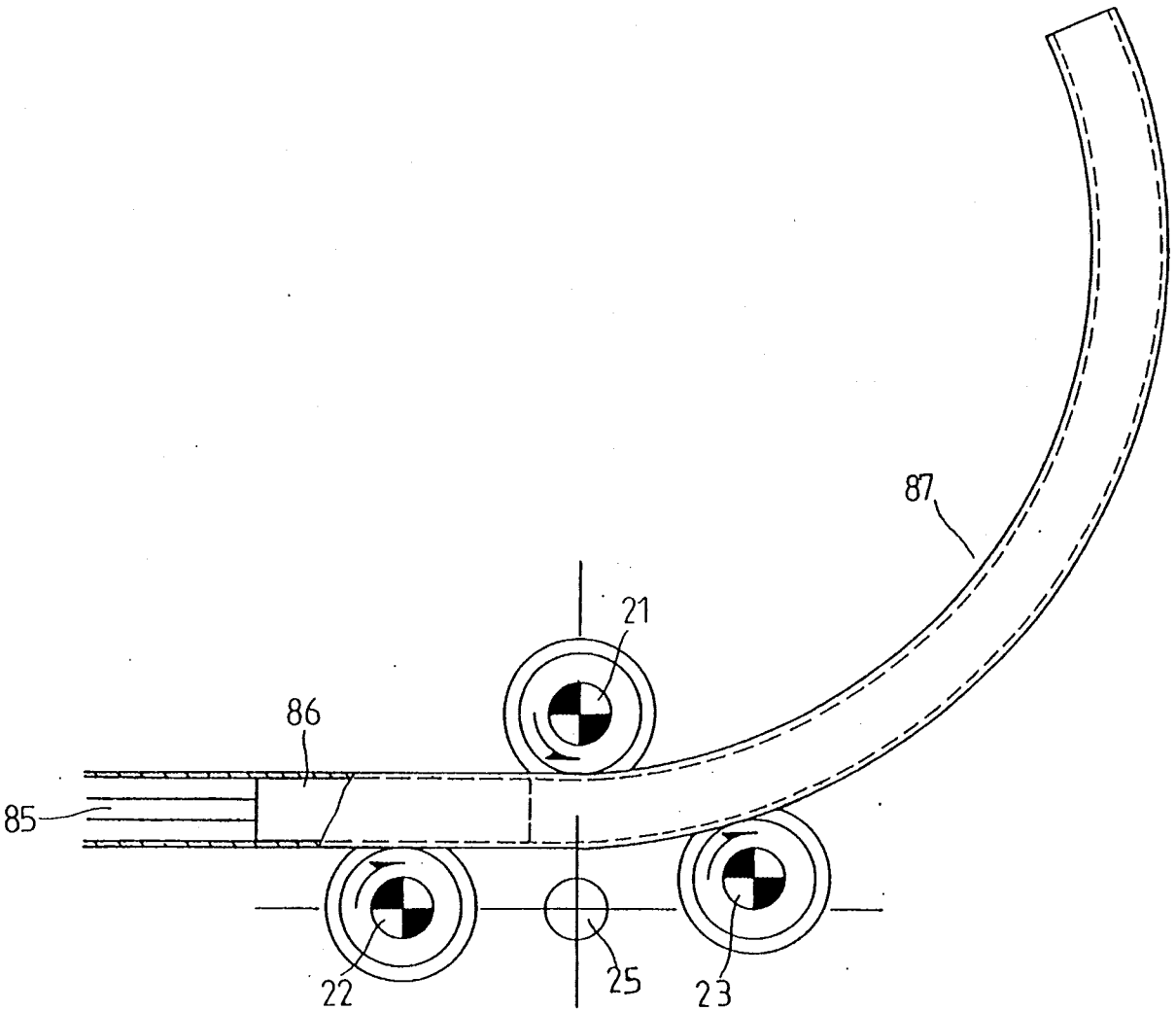
FIG. 7 is a view showing the curving configuration of this invention.

Now refer to FIG. 7 which shows the pipe bender during the bending process. The right roller 23 of the embodiment is lifted to a pre-determined position, and the right portion of the metal pipe 87 is bent upwards. The higher the height of the center of the right roller 23 is, the smaller the diameter of the circular metal pipe ring of metal pipe 87 becomes. Now, the hydraulic mechanism 6 and gear group 3 are started, and the top roller 21, left roller 22, and right roller 23 of the roller group 2 are driven. However, the top roller 21 turns counter-clockwise, whereas the left roller 22 and right roller 23 turn clockwise, in conjunction with guiding rod 85 and guiding mould 86 of the guiding mechanism 8, metal pipe 87 is moved rightward and bent gradually. Meanwhile, the hydraulic motor 95 of the feeding mechanism 9 (shown in FIG. 4) is moved by hydraulic mechanism 6, so that hydraulic motor 95 is rotated by hydraulic mechanism 6 to drive helical gear 94 which drive the pinion 93, and the rack 82 on the base 81 is meshed with pinion 93, thus feeding seat 91 is moven rightward. During a forceful pushing of metal pipe 87, the slipping or staggering phenomena can be avoided and a circular metal pipe ring with a large diameter can be made smoothly. The metal pipe 87 can be rounded into a smooth circular ring of a large diameter. Then this circular ring is taken off and its two loose ends can be welded together.

Figure 8:
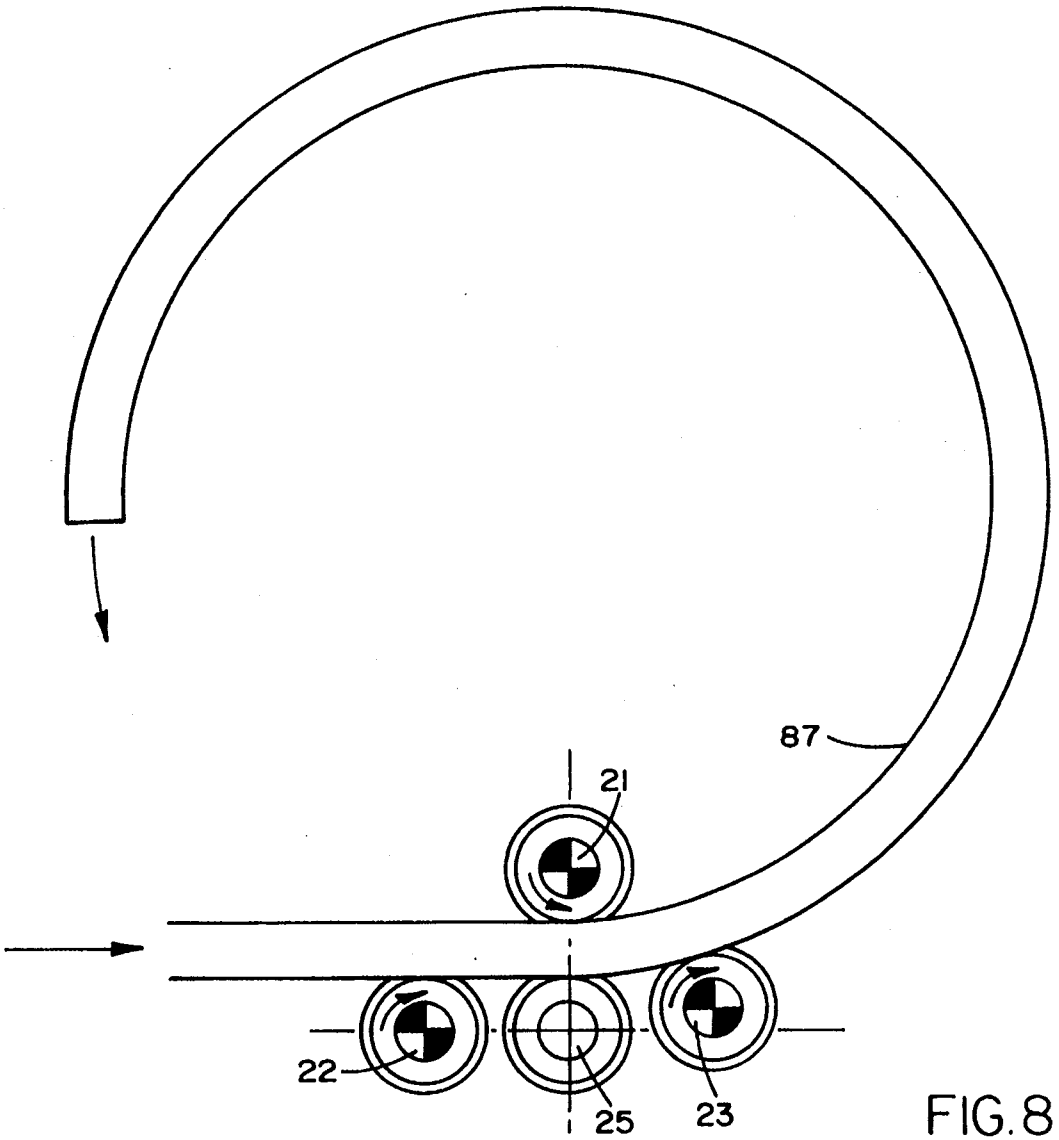
FIG. 8 is a view showing the curving configuration of a slim pipe of this invention.

Now refer to FIG. 8 which shows the pipe bender bending a slim pipe. A central roller 25 is located between the left roller 22 and the right roller 23 of the roller group 2, and exactly below the top roller 21. When a slim metal pipe 87 is bent, a proper mould 29 is installed at the front portion of central roller 25, so that metal pipe 87 is near left roller 22 and the top of central roller 25; and metal pipe 87 is supported by central roller 25 to avoid strain or folding during the bending and curving procedure.

Figure 9:
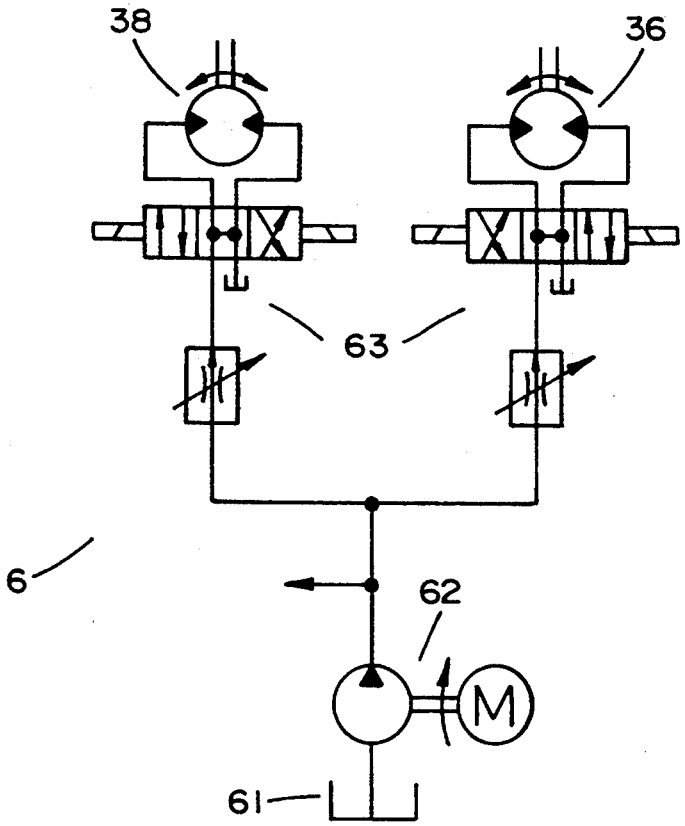
FIG. 9 is a hydraulic circuit diagram for the roller group of the piper bender of this invention.
Figure 11:
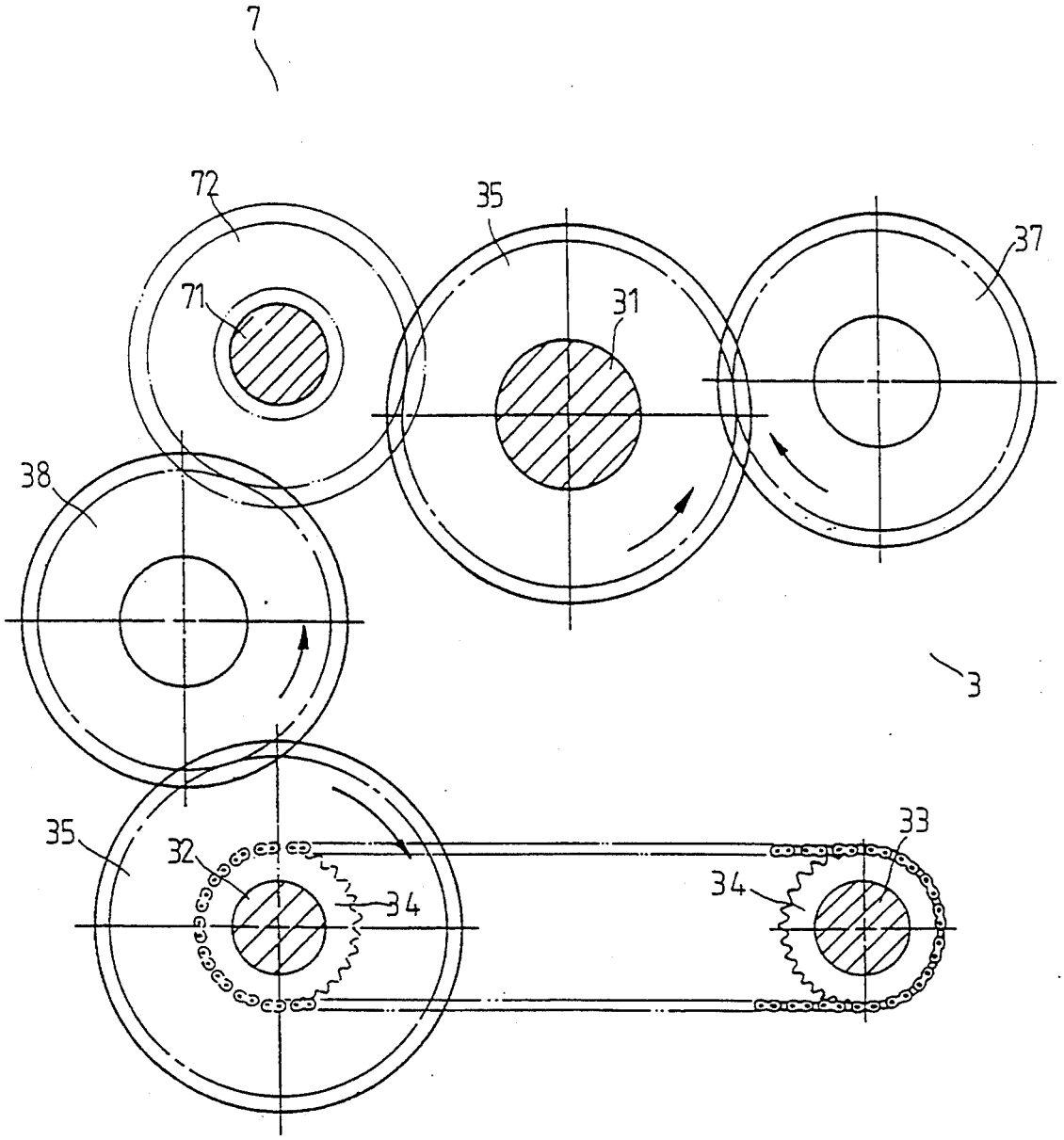
FIG. 11 is a diagram showing the disengaging status of the clutch mechanism of this invention.

Now refer to FIG. 9 which shows the hydraulic circuit diagram of the roller group of this pipe bender of the present embodiment, and FIG. 10 which shows the engaging motion of the clutch mechanism of this pipe bender, and FIG. 11 which shows the disengaging motion of the clutch. The gear box 11 contains top shaft 31, left shaft 32, right shaft 33 which extend front to rear to transmit and engage top roller 21, left roller 22, right roller 23, top shaft 31 and left shaft 32; each is provided with a gear 35. A chain wheel 34 is provided at the rear portion of left shaft 32, and right shaft 33 and chain wheel 34 are connected by a chain, so that left roller 22 and right roller 23 are connected and rotate synchronously along the same direction.

The top hydraulic motor 36 and the left hydraulic motor 38 are both fixed at the front end of gear box 11, whose shafts penetrate into gear box 11 to connect with gears 37 and 39. The gear 37 of the top hydraulic motor 36 meshes with gear 35 of the top shaft 31, while gear 39 of the left hydraulic motor 38 meshes with gear 35 of the left shaft 32.

The fixed shaft 71 of the clutch mechanism 7 is fixed at the upper left of gear box 11, and a clutch gear 72 is sheathed and pivoted around a fixed shaft 71. By means of a handle 73 (refer to FIG. 2), clutch gear 72 is pushed on a fixed shaft 71 to proceed to a forward fixing or a rearward fixing, so that gear 35 and gear 39 can mesh with each other or become disengaged.

The hydraulic mechanism 6 contains oil tank 61 and hydraulic pump 62 as the power source and with the help of control valve 63, to drive and control gear group 3, lifting mechanism 4, guiding mechanism 8, and feeding mechanism 9. In FIG. 9, the hydraulic circuit of lifting mechanism 4, guiding mechanism 8 and feeding mechanism 9 are not drawn, for they belong to conventional technique.

An electrical power panel 10 is mounted above oil tank 61 of the hydraulic mechanism 6, and the push button sets can be remotely controlled by attaching electrical wire outward (the push button groups are not shown in the figure). By means of a push button group and circuit operation, gear group 3, lifting mechanism 4, hydraulic mechanism 6, guiding mechanism 8 and feeding mechanism 9 are controlled.

During actual operation, if the top roller 21, or left and right rollers 22 and 23 are unable to cooperate with the circular metal pipe to be bent, clutch gear 72 is disengaged from gears 35 and 39 by moving handle 73; the top motor 36 rotates top roller 21, and left hydraulic motor 38 rotates left and right rollers 22, 23 synchronously. Now, if the angular speed of the top roller is higher than the predetermined value, then the load of the top roller 21 is increased relatively, and the torque of the top hydraulic motor 36 increases and the speed decreases. However, the left hydraulic motor 38 of the left and right rollers 22 and 23 decrease the torque and increase speed, so that the angular speeds of top, left and right rollers fulfill the need. If the angular speed of top roller 21 is less than the pre-determined value, then the load of the top roller is reduced relatively, and the top hydraulic motor 36 reduces torque and increases speed proportionately, and the left hydraulic motor 38 of the left and right rollers 22, 23 reduce the torque and decreases the speed, so that the angular speeds of the top, left and right rollers 21, 22 23 fulfill the need to manufacture a smooth circular metal pipe ring.

When a metal plate is intended to be bent into a cylinder, it can also be made by moving handle 73, so that clutch gear 72 meshes with gears 35 and 39. Now, the rotating speeds of top, left and right rollers 21, 22 and 23 become completely identical.

Figure 12A:
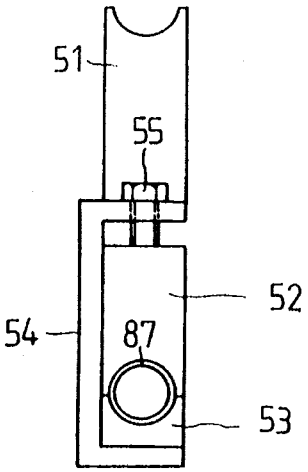
FIG. 12A is a side elevational view of a part of the mechanism of FIG. 12.
Figure 12:
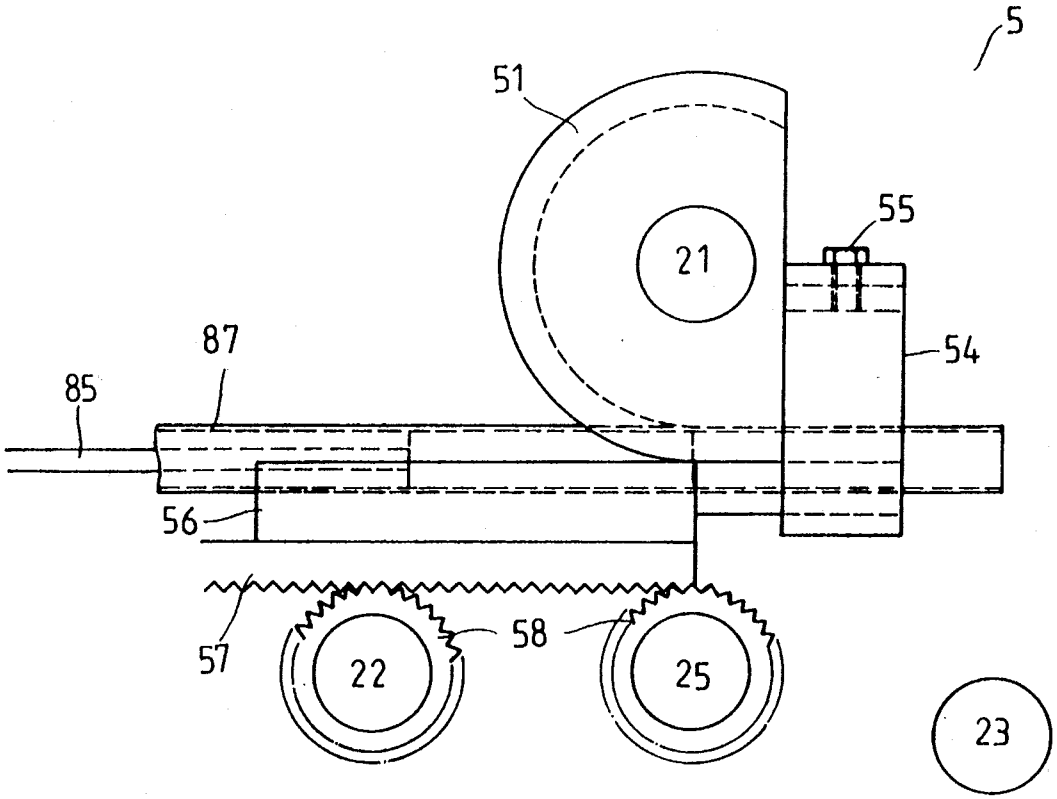
FIG. 12 is a diagram of the bending mechanism of the embodiment of this invention.
Figure 13:
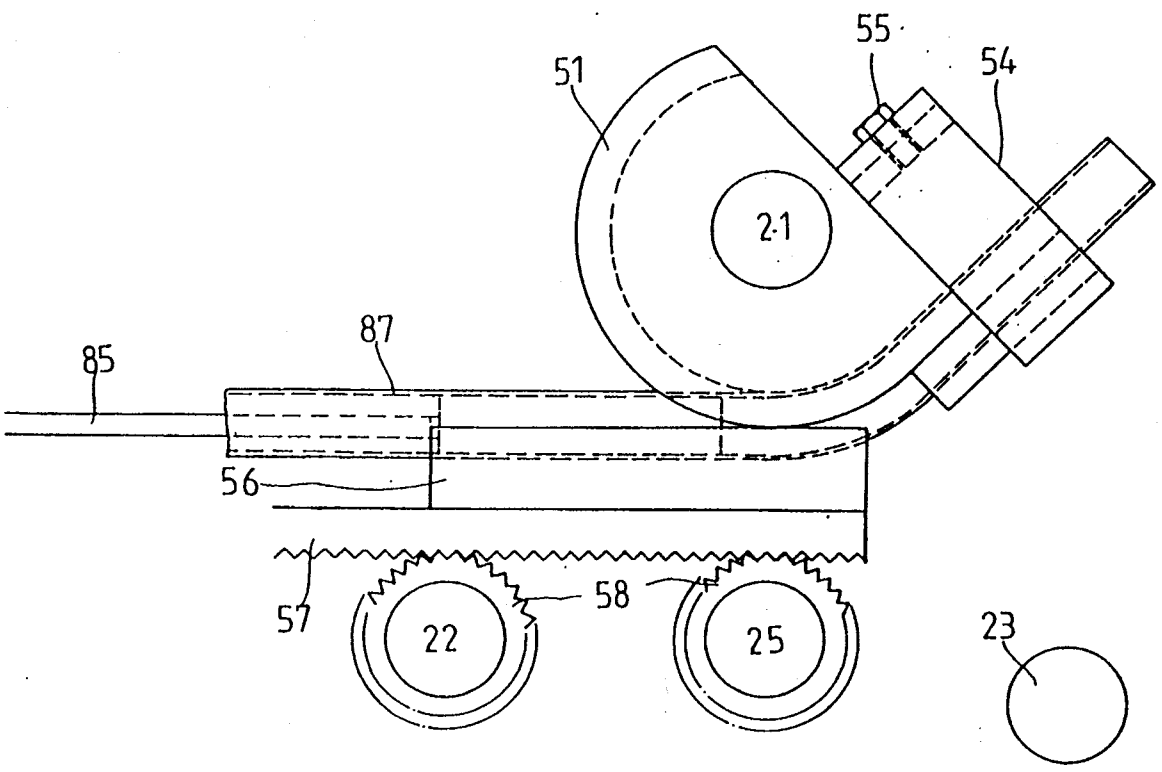
FIG. 13 is a diagram showing the operation of bending a pipe.

Now refer to FIG. 12 which shows the bending mechanism of the pipe bender and FIG. 13. Besides bending a pipe of a large diameter, this embodiment may adopt alternatively bending mechanism 5 which adapts inner mould 51, jaw 52, removable jaw 53, jaw seat 54, outer mould 56, rack 57, gear 58. Firstly, the moulds of top roller 21, left roller 22, central roller 25 are removed, next, inner mould 51 is mounted at top roller 21, whereas gears 58 are mounted at left roller 22 and central roller 25. Meanwhile, right roller 23 is lowered with the principle that it does not hinder the operation. The horizontal rack 57 extending left to right is abridged across on gears 58 of left roller 22, central roller 25, and on rack 57, outer mould 56 with a slot is provided. A jaw 52 extending rightward is mounted under the inner mould 51 of top roller 21. In combination with removable jaw 53 having a slot facing upwards, jaw seat 54 and a fixing screw 55 are used to grip the metal pipe 87, then the general pipe bending process can be started.

Summing up the above, the invention can achieve the following objects:

1. By adjusting the lifting position of the right roller, in combination with the top roller and left roller, the diameter of the pipe to be bent can be pre-determined.
2. Slipping or staggering phenomina can be prevented during pipe bending process by means of feeding mechanism and guiding mechanism, so that a metal pipe ring of large dimension can be bent smoothly.
3. By providing a central roller below the top roller, a metal pipe of slim wall can be bent easily.
4. The roller group can adjust the speed according to the load variation.

It is understood by those skilled in the art that this invention should not be construed as restrictive to the above described embodiment and that various changes and modifications may be made in the invention without departing from the gist and scope thereof.

Other objects and advantages of this invention will become apparent from the detailed descriptions above taken in conjunction with the appended claims.

I claim:

1. A hydraulic pipe bender of large dimension comprising:

a rectangular frame having a head seat at a front end thereof and a tail seat at a central section thereof;

a roller group, including top, left and right rollers whose shafts pass through the head seat and tail seat and a central roller between the left and right rollers directly below the top roller to support the metal pipe, the left, central and right rollers rotate synchronously in the same direction;

a gear group mounted in a gear box located at a rear end of the frame and including top, left and right shafts connected with the top, left and right rollers respectively; the top shaft with the top roller is driven by a first hydraulic motor and the left and right shafts with the left and right rollers are driven by a second hydraulic motor;

a lifting mechanism, with a thread lifter provided at the head seat and tail seat respectively to lift or lower the top roller and the right roller;

a hydraulic mechanism providing hydraulic power to the first and second hydraulic motors of the gear group;

a guiding mechanism having a base located at a front portion of the frame, a left end of the base being provided with a hydraulic cylinder connected to a guide rod disposed inside a metal pipe to be processed, so that a right section of the metal pipe is mounted across the left and the right rollers, and having a rack above the base thereof extending rightward;

a feeding mechanism having a feeding seat on the base of the guiding mechanism and including a pinion engaged with the rack of said guiding mechansm and a shaft and pinion driven by a hydraulic motor to move said feeding seat horizontally and forcefully push the metal pipe rightward;

whereby the position of said right roller is controlled by said lifting mechanism so that the right section of the metal pipe is bent upwards to obtain a predetermined proper curvature, the rotational speeds of the top roller on the one hand and the left and right rollers on the other hand are automatically adjusted according to load variation by control of the first and second hydraulic motors, respectively, of the gear group, and together with the guiding and feeding mechanisms, the pipe is bent into a circular pipe ring.

2. A hydraulic pipe bender of large dimension according to claim 1, wherein the left shaft and the right shaft in the gear group are driven by chain wheels and chains.

3. A hydraulic pipe bender of large dimension according to claim 1, wherein the top shaft and the right shaft in the gear group are driven by a gear and a clutch gear.

4. A hydraulic pipe bender of large dimension according to claim 1, wherein a guiding mould is provided at a right end of the guiding rod of the guiding mechanism to comply with the shape of the inner part of the metal pipe to be bent, and the guiding mould is positioned above the left roller.

* * * * *